US005524916A

United States Patent [19]

Redens

[11] Patent Number: 5,524,916

[45] Date of Patent: Jun. 11, 1996

[54] MECHANIC'S CREEPER

[76] Inventor: Raymond S. Redens, 457 N. Main St., Manchester, Conn. 06040

[21] Appl. No.: 22,926

[22] Filed: Feb. 26, 1993

[51] Int. Cl.[6] ..... B25H 5/00

[52] U.S. Cl. ..... 280/32.6; 280/849; 280/160; 293/127

[58] Field of Search ..... 280/32.6, 849, 280/160; 180/127, 128; 296/180.1; 293/127

[56] References Cited

U.S. PATENT DOCUMENTS

| | | | |
|---|---|---|---|
| 1,737,952 | 11/1928 | Storch et al. | 280/160 |
| 1,805,933 | 5/1931 | Victor | 280/160 |
| 1,823,526 | 9/1931 | Breeden | 280/32.6 |
| 2,124,389 | 7/1938 | Woelfer, Jr. | 280/32.6 |
| 2,291,094 | 7/1942 | McCarthy | 280/32.6 X |
| 2,605,119 | 7/1952 | Earnest | 280/849 |
| 4,133,282 | 1/1979 | Cockerell | 180/128 X |
| 4,237,992 | 12/1980 | Bristow | 180/127 X |
| 4,702,332 | 10/1987 | Prentice | 180/128 X |
| 4,875,694 | 9/1989 | Hamrick | 280/32.6 |
| 4,909,524 | 3/1990 | Paine | 280/32.6 X |
| 4,964,835 | 10/1990 | Suto | 180/128 X |
| 5,078,280 | 1/1992 | Nordeen | 211/86 |
| 5,170,528 | 12/1992 | Navar et al. | 280/160 X |

FOREIGN PATENT DOCUMENTS

| | | | |
|---|---|---|---|
| 0019234 | 2/1905 | Austria | 293/127 |
| 0162107 | 4/1921 | United Kingdom | 280/160 |

OTHER PUBLICATIONS

IBM Technical Disclosure Bulletin, R. B. Wheeler, vol. 6 No. 2, Jul. 1963, "Extruded Kick Strip and Mounting Devices".

*Primary Examiner*—Eric D. Culbreth
*Assistant Examiner*—Florian Zeender
*Attorney, Agent, or Firm*—Ira S. Dorman

[57] ABSTRACT

A mechanic's creeper is provided with a surrounding skirt that serves to deflect tools and other objects lying on the floor, thereby maintaining them accessible to the mechanic.

7 Claims, 2 Drawing Sheets

MECHANIC'S CREEPER

BACKGROUND OF THE INVENTION

Mechanic's creepers are of course in widespread use, and are disclosed in the art in a variety of forms. Exemplary constructions are shown in the following United States patents: Breeden U.S. Pat. No. 1,823,526, issued Sep. 15, 1931; Woelfer, Jr. U.S. Pat. No. 2,124,389, issued Jul. 19, 1938; Hamrick U.S. Pat. No. 4,875,694, issued Oct. 24, 1989; and Nordeen U.S. Pat. No. 5,078,280, issued Jan. 7, 1992.

A source of substantial frustration for the mechanic is the tendency that exists for tools and parts to become misplaced, and therefore inaccessible, under the creeper. Such objects lying in the path of its casters or wheels may also interfere with free movement.

The above-identified patent to Nordeen recognizes the general problem of misplaced tools and the like, and addresses it by providing a shelf on the creeper for holding them. The patents to Breeden and Woelfer, Jr. provide creepers that have peripheral flanges, and Hamrick discloses a creeper of unconventional design.

SUMMARY OF THE INVENTION

It is the broad object of the present invention to provide a novel mechanic's creeper that is so constructed as to prevent the passage of tools and other objects therebeneath, to minimize their misplacement and also to avoid interference with creeper movement.

More specific objects of the invention are to provide such a creeper which is of relatively uncomplicated construction and facile manufacture, and of which functional components may readily be replaced for extended useful life.

It has now been found that certain of the foregoing and related objects of the invention are attained by the provision of a mechanic's creeper that includes a body-supporting panel, a plurality of rollers (i.e., casters or wheels) operatively disposed beneath the panel, and a flexible skirt extending substantially entirely about the panel periphery. The rollers afford mobility, and elevate the panel above ground level in the generally horizontal position of normal use; a lower marginal portion of the skirt contacts the floor, and thereby prevents the passage of objects under the creeper.

Normally, the marginal portion of the skirt will flare outwardly beyond the supporting panel. The skirt will desirably be fabricated as a multiplicity of separate, elongate pieces that cooperatively surround the panel, to which they will preferably be disengageably affixed. For that purpose, the skirt pieces may be formed with upper edge beads, and the creeper panel may be provided with structure that defines a peripheral channel in which the edge beads are slidably engaged to affix the skirt pieces in position. Most desirably, at least certain of the skirt pieces will have curved portions at one or both ends, which portions wrap about the end portion of an adjacent piece to avoid the presence of a gap therebetween.

DETAILED DESCRIPTION OF THE ILLUSTRATED EMBODIMENTS

Figure 1:
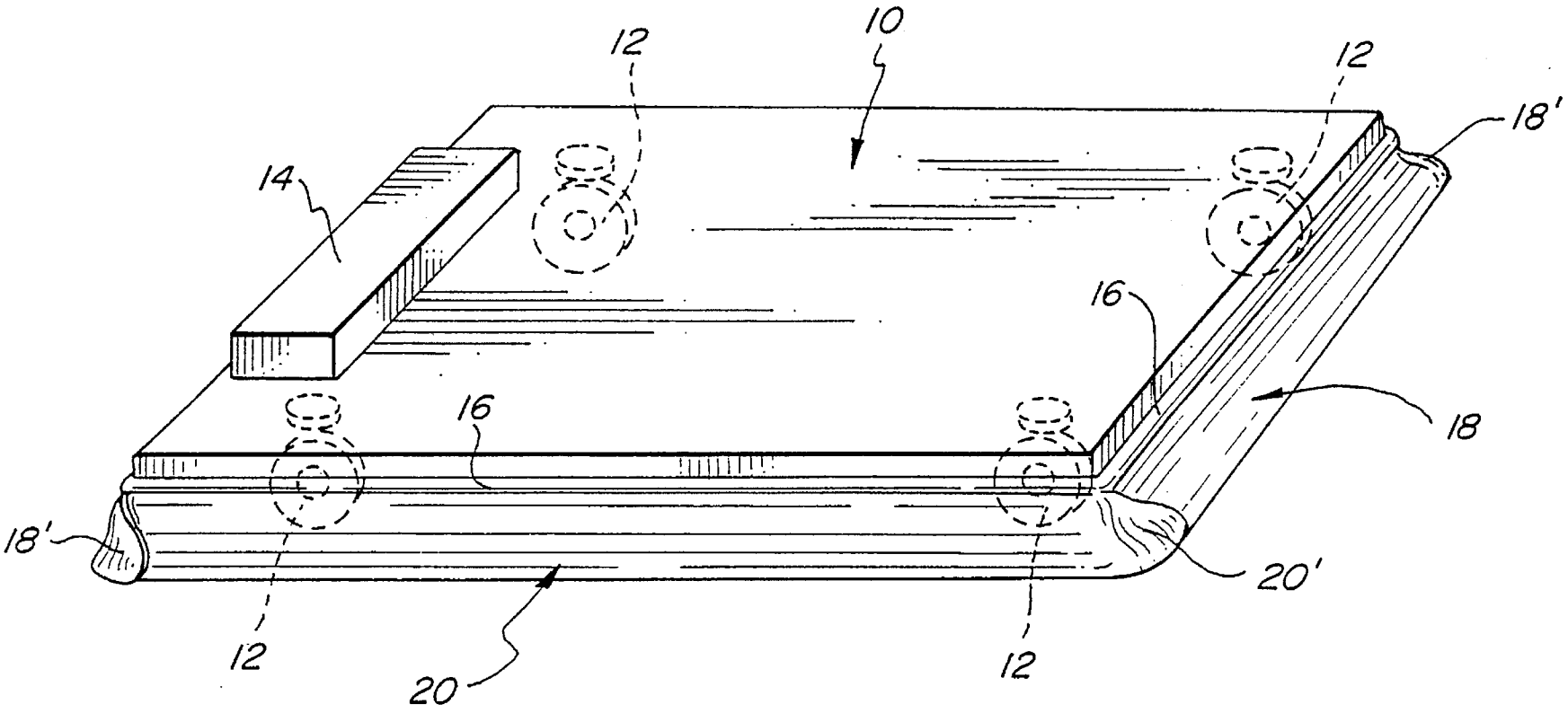
FIG. 1 is a perspective view showing a mechanic's creeper embodying the present invention.

Turning now in detail to FIG. 1 of the appended drawings, therein illustrated is a creeper embodying the present invention and including a planar body-supporting panel, generally designated by the numeral 10, of rectangular configuration. The panel 10 has a caster 12 mounted on its underside at each corner, and an elongated pad 14 of resilient material extends transversely along one end on the upper surface of the panel 10 to provide an elevated head rest. As will be appreciated, the creeper described thus far is of entirely conventional construction.

Four open-ended channel-defining pieces 16 (only two of which are visible) extend about the periphery of the panel 10; each piece 16 serves to engage the upper edge of a flexible, resiliently deflectable skirt piece, generally designated by the numeral 18 or 20 (the difference therebetween residing solely in their lengths). The skirt pieces 18, 20 have curved end portions 18', 20', respectively, which wrap about the corners of the creeper and overlap the end portion of the adjacent skirt piece; although not clearly visible in the drawing, the overlapped end portion will desirably also curve about the corner.

It will be appreciated that the skirt, comprised of the four pieces 18, 20, reaches to ground level and is indeed of sufficient height to flare outwardly over the floor. This will of course help to maintain the lower marginal portion of the skirt in floor contact, to best ensure that objects encountered during movement of the creeper will be deflected or swept out of the way, and thus kept accessible to the mechanic.

Figure 2:
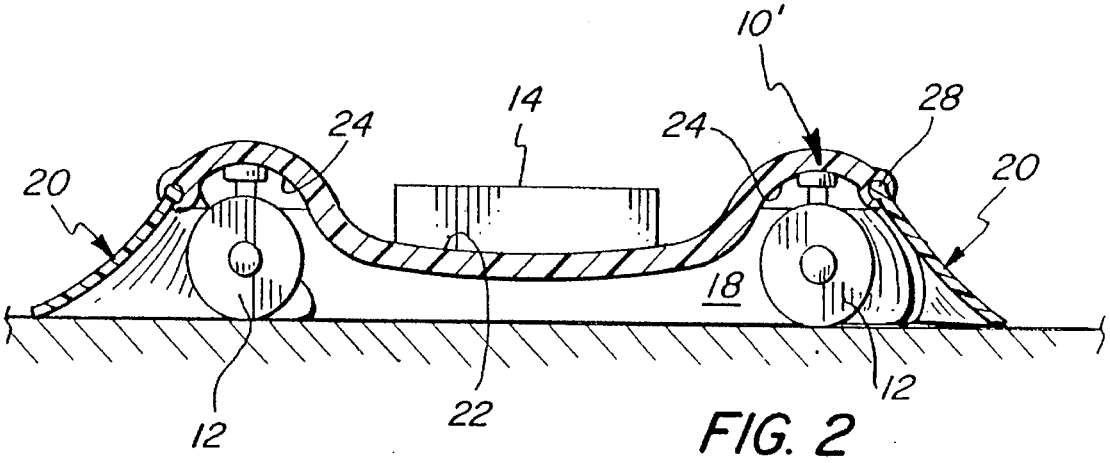
FIG. 2 is a transverse cross-sectional view of a creeper embodying the invention, the panel of which is of modified form.
Figure 3:
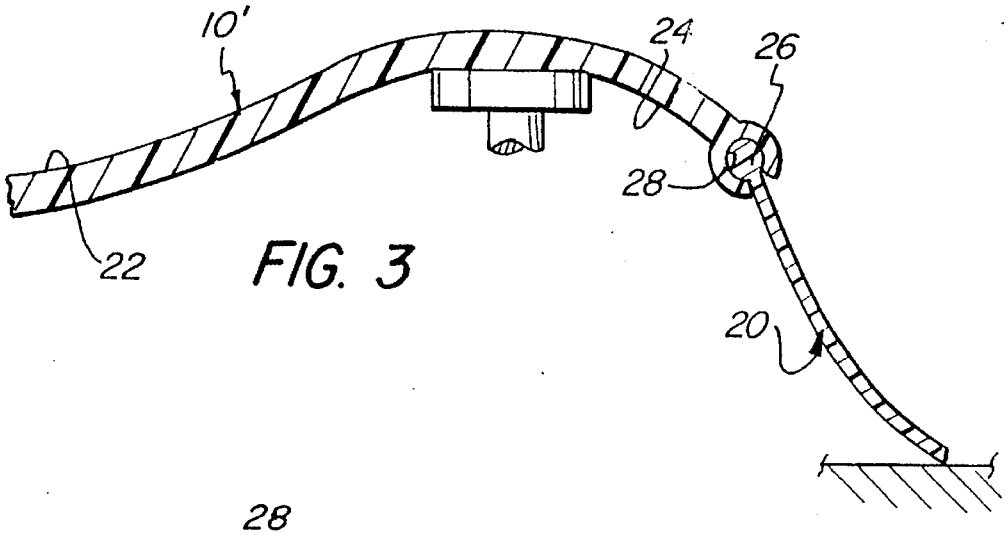
FIG. 3 is a fragmentary view of the right-hand portion of the creeper of FIG. 2, drawn to an enlarged scale.

Turning now to FIGS. 2 and 3, the illustrated creeper panel, generally designated by the numeral 10', is also of conventional configuration but differs from that of FIG. 1 by virtue of its longitudinally extending depression 22 and its arched wheel-well formations 24; these features give the creeper a low-slung character, which will be preferred in many instances. As best seen in FIG. 3, the channel-forming element 16' is molded into the edge of the panel 10', and defines a channel 26 along its length. The skirt piece 20 has a corresponding bead element 28 extending along its upper edge, which is slidably engaged in the channel 26 to afford a readily disengageable but secure assembly.

Figure 4:
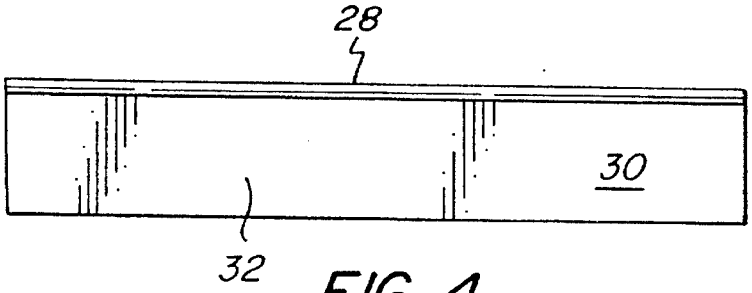
FIGS. 4 and 5 are, respectively, side and end elevational views of skirt pieces suitable for use in the creeper of the invention.
Figure 5:
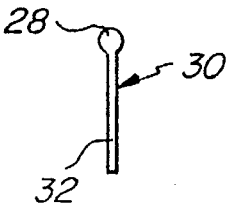

Straight skirt pieces (i.e., pieces having no curved end portion), generally designated by the numeral 30, are illustrated in FIGS. 4 and 5 and may be employed in lieu of the components previously described, if so desired. As can be seen, they consist simply of a rectangular panel 32 having a bead 28 along its upper edge. It will be appreciated that, as an alterative to the separate skirt pieces hereinbefore described a unitary, integrally formed skirt member may be utilized, with of course suitable mounting means being provided on the creeper.

The casters or wheels employed may be of any appropriate form and, like the skirt pieces, will desirably be replaceable. Although other appropriate materials may be used, the creeper will preferably be fabricated predominantly from plastics; e.g., the panel may desirably be molded from an ABS material, Fiberglas or other fiber-reinforced resin composite, or the like, and the skirt pieces may be molded from a vinyl plastic, polyethylene, or other resin suitable for the purpose, as herein described.

Thus, it can be seen that the present invention provides a novel mechanic's creeper which is so constructed as to prevent the passage of tools and other objects beneath it, so as to minimize misplacement of the objects and also to avoid interference with free creeper movement. The creeper is of relatively uncomplicated construction and facile manufacture, and functional components thereof may readily be replaced for extended useful life.

Having thus described the invention, what is claimed is:

1. In a mechanic's creeper, including a body-supporting panel having an exterior periphery and a plurality of rollers operatively disposed beneath said panel, and contacting the floor at the lowest portions of said rollers, said rollers elevating said panel above ground level in a generally horizontal position for normal use of said creeper, and affording mobility thereto; the improvement wherein said creeper further includes a flexible, resiliently deflectable, single-wail skirt affixed to said panel and extending substantially entirely about said periphery of said panel, said skirt having a lower marginal portion that extends to the level of the lowest portions of said rollers and contacts the floor in said position of normal creeper use.

2. The creeper of claim 1 wherein said skirt is so constructed that said marginal portion of said skirt flares outwardly beyond said periphery of said panel in said position of normal use.

3. The creeper of claim 1 wherein said skirt is fabricated from a synthetic resinous material.

4. The creeper of claim 1 wherein said skirt comprises a multiplicity of separate, elongate skirt pieces which cooperatively surround said panel.

5. The creeper of claim 4 wherein each of a plurality of said skin pieces has at least one curved end portion thereon that wraps about the end portion of an adjacent skirt piece to avoid the presence of a gap therebetween.

6. The creeper of claim 4 wherein said skirt pieces are disengageably affixed to said panel.

7. The creeper of claim 6 wherein a upper marginal portion of each of said skirt pieces has an edge bead extending therealong, and wherein said panel has structure defining a channel extending substantially about said periphery thereof in which channel said edge beads are slidably engaged to disengageably affix said skirt pieces in a position on said panel.

* * * * *

UNITED STATES PATENT AND TRADEMARK OFFICE

CERTIFICATE OF CORRECTION

PATENT NO. : 5,524,916

DATED : June 11, 1996

INVENTOR(S) : RAYMOND S. REDENS

It is certified that error appears in the above-indentified patent and that said Letters Patent is hereby corrected as shown below:

Claim 1, column 3, line 20, delete "single-wail" and substitute therefor --single-wall--.

Claim 5, column 4, line 11, delete "skin" and substitute therefor --skirt--.

Signed and Sealed this

Third Day of September, 1996

*Attest:*

Bruce Lehman

BRUCE LEHMAN

*Attesting Officer*

*Commissioner of Patents and Trademarks*